US005873702A

United States Patent [19]

Corley et al.

[11] Patent Number: 5,873,702

[45] Date of Patent: Feb. 23, 1999

[54] APPARATUS AND METHOD FOR SEALING GAS TURBINE BLADE ROOTS

[75] Inventors: Thomas J. Corley, Winter Springs; Donald P. Etchison, Lake Mary, both of Fla.; George Dailey, Pittsburgh, Pa.

[73] Assignee: Siemens Westinghouse Power Corporation, Orlando, Fla.

[21] Appl. No.: 880,180

[22] Filed: Jun. 20, 1997

[51] Int. Cl.[6] ..... F01D 5/30

[52] U.S. Cl. ..... 416/213 R; 416/220 R; 416/221; 416/248; 156/94; 156/578; 29/889.21

[58] Field of Search ..... 416/219 R, 220 R, 416/221, 248, 213 R; 156/94, 305, 329, 578; 29/889.21, 889.22, 889.1; 277/316, 630

[56] References Cited

U.S. PATENT DOCUMENTS

| | | | |
|---|---|---|---|
| 3,910,719 | 10/1975 | Hessler et al. | 416/219 R |
| 4,183,720 | 1/1980 | Brantley . | |
| 4,502,511 | 3/1985 | Zafred | 156/94 |
| 4,938,835 | 7/1990 | Ludwig | 156/578 |
| 5,062,919 | 11/1991 | McPherson et al. | 156/578 |
| 5,257,909 | 11/1993 | Glynn et al. . | |
| 5,320,492 | 6/1994 | Bouru et al. . | |
| 5,362,342 | 11/1994 | Murray et al. | 156/578 |
| 5,429,706 | 7/1995 | Cresse et al. | 156/578 |
| 5,558,500 | 9/1996 | Elliott et al. . | |
| 5,599,170 | 2/1997 | Marchi et al. . | |

FOREIGN PATENT DOCUMENTS

| | | | |
|---|---|---|---|
| 58-183801 | 10/1983 | Japan | 416/221 |
| 61-255201 | 11/1986 | Japan | 416/219 R |

*Primary Examiner*—Christopher Verdier

[57] ABSTRACT

A sealing apparatus and method for delivering a sealing material to gaps between gas turbine blade roots and the corresponding grooves of a rotor disc are disclosed. The sealing apparatus comprises a tank for housing a pressurized sealing material, a delivery tube for delivering the sealing material from the tank to the rotor disc, a control valve for controlling the flow of the sealing material, a sealing fixture for distributing the sealing material to the gaps between the blade roots and the corresponding grooves, an O-ring seal for effecting a tight seal between the sealing fixture and the rotor disc, and jack screws for maintaining the sealing fixture securely in place.

12 Claims, 3 Drawing Sheets

APPARATUS AND METHOD FOR SEALING GAS TURBINE BLADE ROOTS

FIELD OF THE INVENTION

The present invention relates generally to gas turbines, and more particularly to an apparatus and method for sealing the gaps between gas turbine blade roots and the corresponding grooves of a rotor disc.

BACKGROUND OF THE INVENTION

Gas turbines comprise a casing for housing a compressor section, combustion section and turbine section. The compressor section comprises an inlet end and an outlet end. The combustion section comprises an inlet end and a combustor transition. The combustor transition is proximate the discharge end of the combustion section and comprises a wall that defines a flow channel that directs the working fluid into the turbine inlet end.

A supply of air is compressed in the compressor section and directed into the combustion section. The compressed air enters the combustion inlet and is mixed with fuel. The air/fuel mixture is then combusted to produce high temperature and high pressure gas. This gas is then ejected past the combustor transition and injected into the turbine section to run the turbine.

Gas is forced through the blades of a gas turbine to run the turbine and produce electricity by causing the rotor to drive a generator. The blades of a turbine, as well as the blades in the compressor section of a turbine, typically comprise an airfoil, a platform, a shank and a root that fits into a complementary-shaped groove formed in the periphery of a rotor disc, which itself is located on the periphery of the rotor.

The airfoil portion of the blade is the distal portion of the blade that translates the axial flow of the gas to rotor rotation. Moving radially inward, the platform is the portion of the blade that rests on the outer surface of the rotor disc. The shank is the portion that extends down into the rotor disc from the platform and usually has a narrower cross-section than that of the platform. The root is the bottom portion of the blade that has a jagged or dovetail shape so as to fit securely within the groove of the rotor disc, which has a correspondingly complementary shape to that of the blade root.

During the operation of a gas turbine, the working gas can leak through gaps between the turbine blade roots and the corresponding grooves of a rotor disc. This yields a reduction in working gas to turn the turbine blades, thereby reducing the efficiency of the turbine section. Likewise, air in the compressor section of a gas turbine can leak through these same gaps. Thus, not all of the air entering the compressor is compressed, resulting in a decrease in efficiency of the compressor section. Leakage occurring in the compressor section of the turbine section reduces the efficiency of the gas turbine.

To prevent any leakage between the turbine blade roots and the corresponding grooves of a rotor disc, those skilled in the art have utilized several methods to seal this space. A common technique, during turbine assembly, is to affix a sealing device to the blade root and then mount the blade in the corresponding groove of the rotor disc. One such sealing method, disclosed in U.S. Pat. No. 5,558,500, is to affix an elastomeric seal made of silicone rubber to a portion of a blade root and then mount the blade root in the groove of a compressor rotor disc. This technique, as well as other prior art techniques, however, require sealing the gaps prior to mounting the turbine blades onto a rotor disc.

Therefore, to seal the gaps between turbine blade roots and corresponding grooves on a rotor disc of a working gas turbine, prior art sealing techniques require disassembly of the turbine. These prior art sealing procedures result in significant downtime of the turbine at a significant cost to the operator or customer. It is thus desirable to provide a sealing technique for retrofit application, allowing for sealing the gaps between turbine blade roots and corresponding grooves of a rotor disc while not requiring disassembly of any components of the gas turbine.

SUMMARY OF THE INVENTION

A sealing apparatus and method for delivering a sealing material to gaps between gas turbine blade roots and the corresponding grooves of a rotor disc are disclosed. The sealing apparatus comprises a tank for housing a pressurized sealing material, a delivery tube for delivering the sealing material from the tank to the rotor disc, a control valve for controlling the flow of the sealing material, a sealing fixture for distributing the sealing material to the gaps between the blade roots and the corresponding grooves, an O-ring seal for effecting a tight seal between the sealing fixture and the rotor disc, and jack screws for maintaining the sealing fixture securely in place.

The method for delivering a sealing material to gaps between turbine blade roots and the corresponding grooves of a rotor disc comprises the steps of positioning the sealing fixture on the side face of a rotor disc, actuating the jack screws until their free ends abut the side face of an adjacent rotor disc, mixing a sealing material, which is preferably a resilient, high temperature resin, with a hardener or catalyst sealing and pressurizing the resin with an inert gas such as nitrogen, and actuating the control valve to control the flow of the sealing material.

The resin is conducted through the sealing fixture until it reaches the side face of the rotor disc so as to deliver the resin to the gaps and resiliently seal the same. The sealing fixture is moved to enclose or cover the next series of rotor blade root/groove gaps to seal those gaps. The sealing fixture may be sized to seal any number of gaps.

DETAILED DESCRIPTION OF THE PREFERRED EMBODIMENTS

Figure 1:
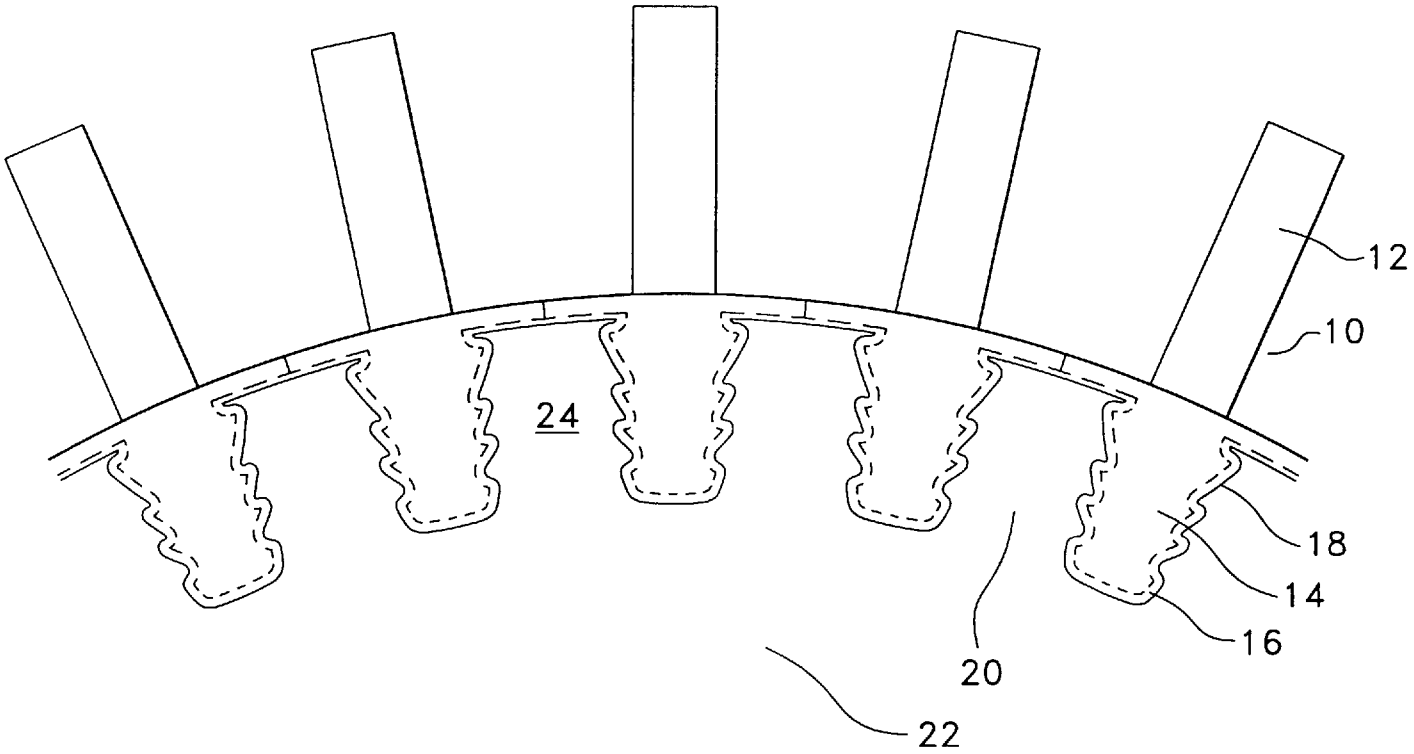
FIG. 1 (PRIOR ART)
FIG. 1 is a partial, side elevation view of a conventional, prior art rotor disc.

Referring to the drawings, wherein like numerals indicate like elements, there is shown in FIG. 1 a partial, side elevation view of a conventional, prior art rotor disc 20. The rotor disc 20, located on the periphery of a rotor body 22 in either a compressor section or turbine section of a gas turbine, has a plurality of grooves 18 situated around the circumference of the rotor disc 20.

The rotor blades 10, each comprising an airfoil 12 and a blade root 14, fit into the grooves 18 of the rotor disc 20. The grooves 18 are designed to secure the rotor blades 10 in place on the rotor disc 20. Gaps 16 between the blade roots 14 and the corresponding grooves 18, however, result when the rotor blades 10 are mounted on the rotor disc 20 due to manufacturing tolerances and the need to provide space for expansion.

Figure 2:
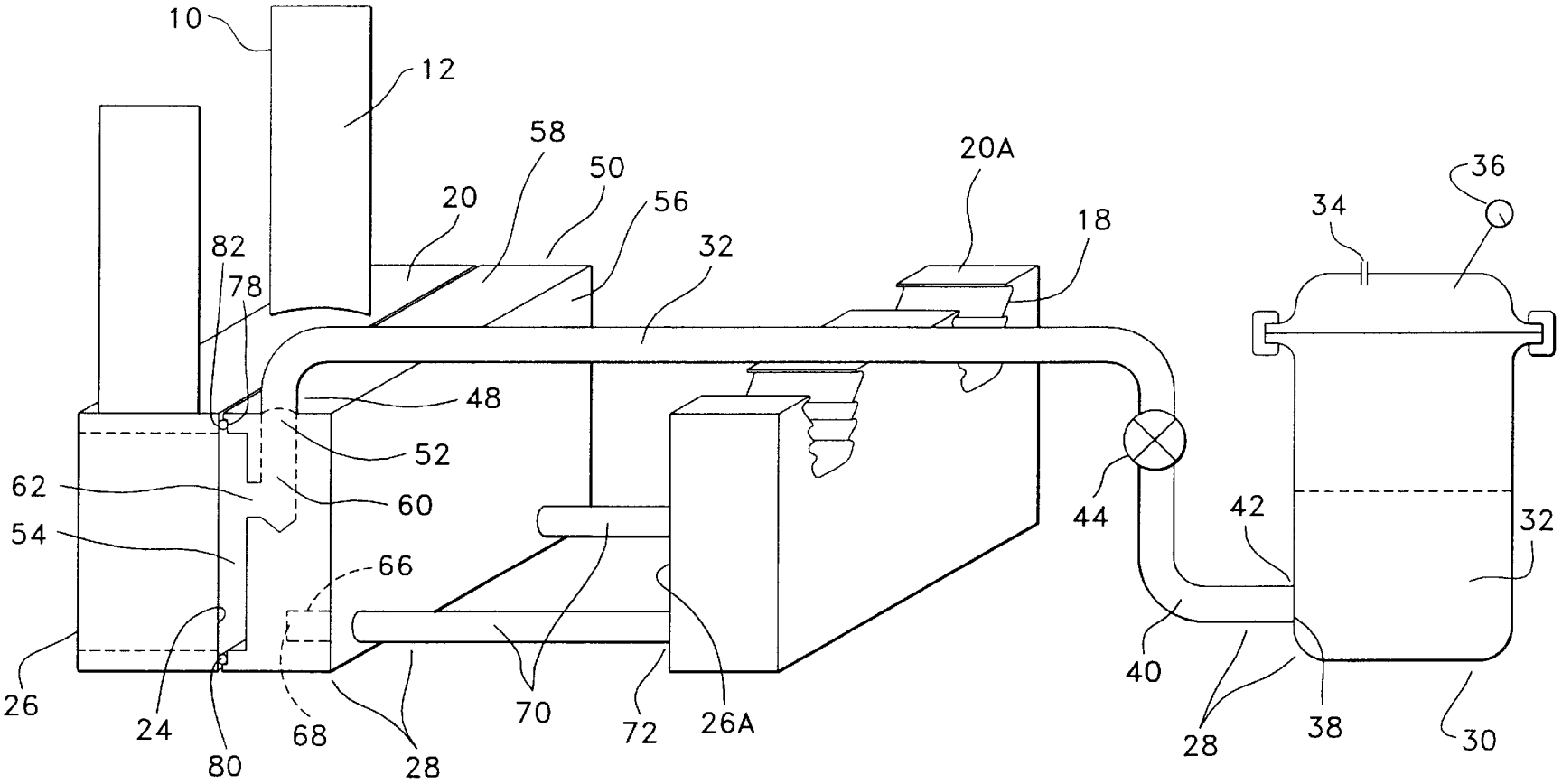
FIG. 2 is a perspective view of a sealing apparatus, according to the invention, illustrated in cooperation with a rotor disc.

FIG. 2 shows a preferred embodiment of a sealing apparatus 28 according to the present invention, and is illustrated in cooperation with a rotor disc 20. The function of the sealing apparatus 28 is to deliver a sealing material 32 to the gaps 16. The sealing apparatus 28 comprises a tank 30 for housing a pressurized sealing material 32, a delivery tube 40 for delivering the sealing material from the tank 30 to the rotor disc 20, a control valve 44 for controlling the flow of the sealing material 32, a sealing fixture 50 for distributing the sealing material 32 to the gaps 16 between the blade roots 14 and the corresponding grooves 18, an O-ring seal 80 for effecting a tight seal between the sealing fixture 50 and the rotor disc 20, and jack screws 70 for maintaining the sealing fixture 50 securely in place.

The tank 30 houses the sealing material 32 and comprises an outlet port 38. The delivery tube 40 comprises an inlet end 42 and an outlet end 48. The sealing fixture 50 comprises an upper face 58, an open face 54, a closed face 56, an inlet port 52, and a mounting lip 82. Each jack screw 70 comprises a fixed end 68 and a free end 72.

The tank 30 is mechanically coupled in fluid communication with the delivery tube 40 at the junction of the tank's 30 outlet port 38 and the delivery tubels 40 inlet end 42. The control valve 44 is located on and mechanically coupled with the delivery tube 40, preferably in close proximity to its inlet end 42. The delivery tube is mechanically coupled in fluid communication with the sealing fixture 50 at the junction of the delivery tube's 40 outlet end 48 and sealing fixture's inlet port 52, preferably on the upper face 58 of the sealing fixture 50.

The sealing fixture 50 is coupled with the side face 24 of the rotor disc 20 by means of the O-ring seal 80. The mounting lip 78 which spans the border of the open face 54 of the sealing fixture 50 is coupled to the rotor disc 20 at 82. The jack screws 70 are imbedded in mounting holes 66 in the sealing fixture 50 at the fixed ends 68 of the jack screws 70. The free ends 72 of the jack screws 70 abut the side face 26A of the rotor disc 20A adjacent (or facing) the closed face 56 of the sealing fixture 50, as rotor discs 20 and 20A are spaced at intervals, e.g., six inches apart, along the length of a compressor section or turbine section of a gas turbine.

Figure 3A:
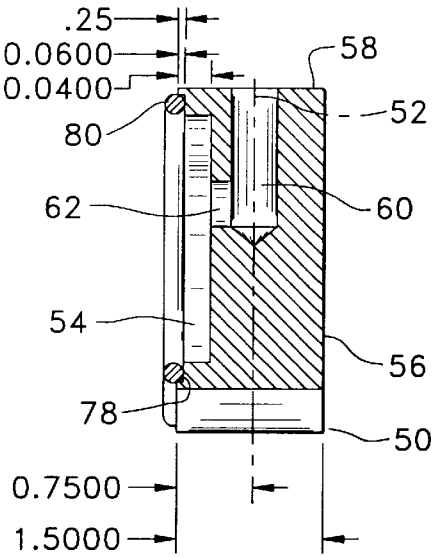
FIG. 3A is a cross-section taken through line 3A—3A of FIG. 3.
Figure 3:
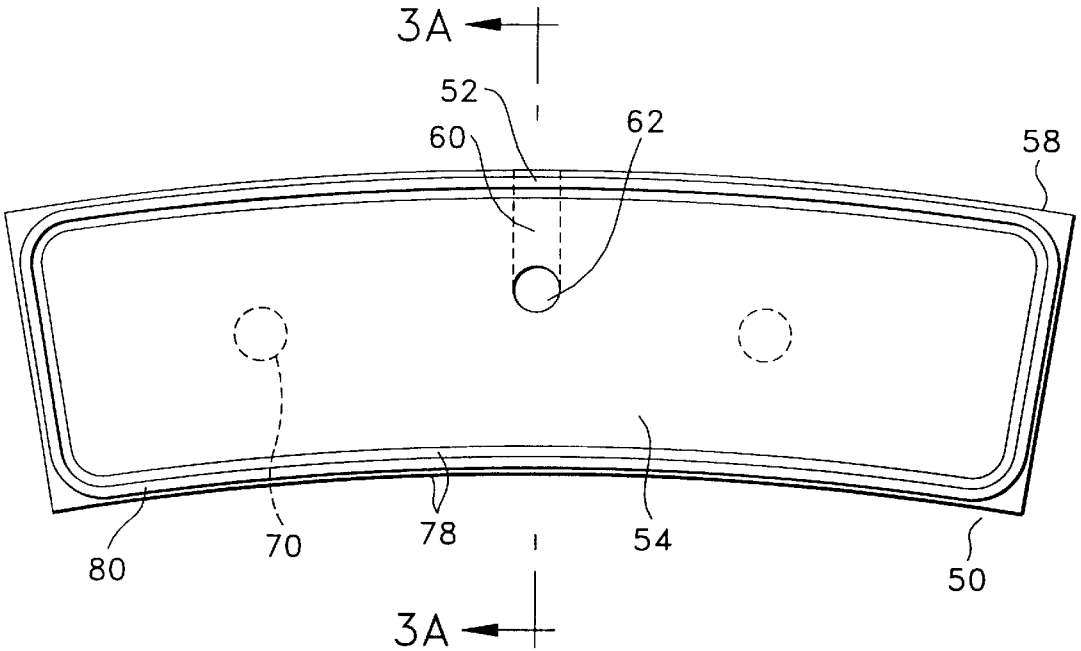
FIG. 3 is a front elevation view of a sealing fixture, according to the invention.

FIG. 3 shows a front elevation view of the sealing fixture 50 according to the invention. In addition to the components mentioned above, the sealing fixture 50 further comprises a central channel 60 for conducting the sealing material 32 through the sealing fixture 50 and an outlet port 62. The central channel 60 extends from the inlet port 52 to the outlet port 62 of the sealing fixture 50. As shown in FIG. 3, the O-ring seal 80 extends all around the mounting lip 78 of the sealing fixture 80.

FIG. 3A shows a more detailed cross-sectional view of the preferred embodiment of the sealing fixture 50 (jack screws 70 not shown). FIG. 3A depicts the approximate dimensions (in inches) of all of the components of a preferred embodiment of the sealing fixture 50.

The operation of the present invention in cooperation with two rotor discs 20 and 20A as shown in FIG. 2 will now be provided. The sealing fixture 50 is positioned on the side face 24 of a rotor disc 20 as shown in FIG. 2 to seal a plurality of gaps 16 between blade roots 14 and corresponding rotor disc grooves 16. The O-ring seal 80 serves to effect a tight seal between the sealing fixture 50 and the rotor disc 20 as the jack screws 70 are actuated until their free ends 72 abut the side face 26A of the adjacent rotor disc 20A.

Sealing material 32 is preferably resilient, is preferably a high temperature resin thoroughly mixed with a hardener or catalyst in the tank 30, and is preferably capable of withstanding high pressure. More preferably, the sealing material 32 is a room temperature vulcanizing (RTV) silicone rubber having suitable operating temperatures. Even more preferably, the sealing material 32 is Dow Corning brand 3120 RTV silicone. The tank 30 is sealed and pressurized with an inert gas such as nitrogen, entering at the inlet port 34, to approximately 125 to 150 psi (lb/in$^2$) that is displayed on the pressure gauge 36.

The control valve 44, provided to control the flow of the sealing material 32, is actuated to allow flow of the sealing material or resin 32 out of the tank 30 at its outlet port 38, through the inlet end 42 of the delivery tube 40 and through the delivery tube 40 toward the sealing fixture 50. The resin 32 exits the delivery tube 40 at its outlet end 48 and enters the sealing fixture 50 at its inlet port 52.

The resin 32 is then conducted through the central channel 60 of the sealing fixture 50 until it reaches the outlet port 62. At the outlet port 62, the resin 32 fills in the space between the open face 54 of the sealing fixture 50 and the side face 24 of the rotor disc 20. The resin 32 is then forced into the gaps 16, as shown in FIG. 1, between the blade roots 14 and corresponding grooves 18 on the rotor disc 20. When resin 32 is visible on the other side face 26 of the rotor disc 20, the sealing of the gap 16 is complete.

The jack screws 70 are then actuated to release the sealing fixture 50 from its tight seal. The rotor disc 20, especially the side face 24 of the rotor disc 20 where gaps 16 were just sealed is cleaned, i.e., any excess resin 32 is wiped away. The sealing fixture 50 is moved to enclose or cover the next series of rotor blade root 14/groove 18 gaps 16 to seal those gaps 16. The sealing fixture 50 may be sized to seal any number of gaps 16.

The foregoing procedure is repeated for any gaps 16 that need sealing. Approximately 12 to 24 hours after application of the resin 32, the turbine can return to service. Thus, a sealing apparatus 28 and sealing technique for retrofit application, allowing for sealing the gaps 16 between gas turbine blade roots 14 and corresponding grooves 18 of a rotor disc 20, is achieved.

The foregoing detailed description provides a sealing apparatus 28 and procedure for sealing blade roots 14 of a compressor section or turbine section of a gas turbine. With a suitable sealing material 32 that can withstand the high temperatures of the turbine section of a steam turbine, however, the invention can also be used to seal the gaps 16 between blade roots 14 and the corresponding grooves 18 of a rotor disc 20 in the turbine section of a steam turbine.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A sealing apparatus, for sealing gaps between blade roots and grooves of a rotor disc of a turbine, comprising:

(a) a tank for housing a pressurized sealing material, the tank having an outlet port;

(b) a delivery tube coupled to the outlet port for delivering the sealing material from the tank to the rotor disc;

(c) a control valve coupled to a first end of the delivery tube for controlling the flow of the sealing material; and (d) a sealing fixture coupled to a second end of the delivery tube for distributing the sealing material to the gaps, so as to deliver the sealing material to the gaps and resiliently seal the same.

2. The sealing apparatus of claim 1, wherein the sealing fixture further comprises an inlet port connected to said second end of the delivery tube, an outlet port, and a central channel, the central channel connecting the inlet port to the outlet port of the sealing fixture in fluid communication.

3. The sealing apparatus of claim 1, wherein the sealing fixture further comprises:

an open face for coupling the sealing fixture to a side face of the rotor disc, enclosing an area where the gaps are located;

a mounting lip spanning the border of the open face; and an O-ring seal for effecting a tight seal between the sealing fixture and the side face;

the sealing fixture being coupled in fluid communication with the gaps between the blade roots and the grooves of the rotor disc.

4. The sealing apparatus of claim 1, wherein:

the sealing apparatus further comprises (e) a plurality of jack screws for maintaining the sealing fixture securely in place, each jack screw having a fixed end and a free end; and the sealing fixture further comprises:

a closed face; and a plurality of mounting holes on the closed face for receiving the jack screws; and wherein the rotor disc defines a first rotor disc and another section of the turbine defines a second rotor disc having a side face adjacent the closed face of the sealing fixture;

the fixed end of each jack screw being imbedded in one of the plurality of mounting holes, the free end of each jack screw abutting the side face of the second rotor disc.

5. The sealing apparatus of claim 1, wherein the turbine is a gas turbine.

6. A method for sealing a plurality of gaps between blade roots and grooves of a rotor disc on a turbine, the rotor disc having a first side face and an opposing second side face, the method comprising the steps of:

(i) providing a sealing apparatus comprising:

(a) a tank for housing a pressurized sealing material, the tank having an outlet port;

(b) a delivery tube coupled to the outlet port for delivering the sealing material from the tank to the rotor disc;

(c) a control valve coupled to a first end of the delivery tube for controlling the flow of the sealing material; and (d) a sealing fixture coupled to a second end of the delivery tube for distributing the sealing material to the gaps, so as to deliver the sealing material to the gaps and resiliently seal the same;

(ii) positioning the sealing fixture on the first side face;

(iii) placing the sealing material in the tank;

(iv) pressurizing the tank;

(v) actuating the control valve to flow the sealing material out of the tank, through the delivery tube and into the sealing fixture until the sealing material reaches the outlet port of the sealing fixture so as to force the sealing material into the gaps between the blade roots and the grooves;

(vi) actuating the valve to stop the flow of the sealing material when the sealing material has flowed to the second side face;

(vii) removing the sealing fixture from the first side face; and (viii) cleaning the rotor disc by removing any excess sealing material on the rotor disc that is not inside the gaps.

7. The method for sealing a plurality of gaps of claim 6, wherein the sealing material is a high temperature resin, and prior to performing step (v), the method further comprises the step of mixing the sealing material with a hardener or catalyst.

8. The method for sealing a plurality of gaps of claim 6, wherein the sealing material is a room temperature vulcanizing silicone rubber, and prior to performing step (v), the method further comprises the step of mixing the sealing material with a hardener or catalyst.

9. The method for sealing a plurality of gaps of claim 6, wherein the sealing material is Dow Corning brand 3120 RTV silicone, and prior to performing step (v), the method further comprises the step of mixing the sealing material with a hardener or catalyst.

10. The method for sealing a plurality of gaps of claim 6, wherein the sealing fixture further comprises:

an open face for coupling the sealing fixture to the first side face of a rotor disc, enclosing an area where the gaps are located;

a mounting lip spanning the border of the open face; and an O-ring seal for effecting a tight seal between the sealing fixture and the first side face of the rotor disc;

the method further comprising the step of maintaining the sealing fixture in place during the sealing of the gaps so as to force the sealing material into the gaps;

the sealing fixture being coupled in fluid communication with the gaps between the blade roots and the grooves of the rotor disc, the O-ring seal serving to effect a tight seal between the sealing fixture and the first side face of the rotor disc.

11. The method for sealing a plurality of gaps of claim 6, wherein the sealing apparatus further comprises:

(e) a plurality of jack screws for maintaining the sealing fixture securely in place, each jack screw having a fixed end and a free end; and the sealing fixture further comprises:

a closed face; and a plurality of mounting holes on the closed face for receiving the jack screws; and wherein the rotor disc defines a first rotor disc and another section of the turbine further defines a second rotor disc having a side face adjacent the closed face of the sealing fixture;

the fixed end of each jack screw being imbedded in one of the plurality of mounting holes;

the method further comprising the steps of:

prior to performing step (v), actuating the jack screws until the free end of each jack screw abuts the side face of the second rotor disc so as to maintain the sealing fixture in place during the sealing of the gaps so as to force the sealing material into the gaps; and prior to performing step (vii), actuating the jack screws until the free ends are separated from the side face of the second rotor disc.

12. The method for sealing a plurality of gaps of claim 6, wherein the turbine is a gas turbine.

* * * * *